US009737112B2

(12) United States Patent
Kramer

(10) Patent No.: US 9,737,112 B2
(45) Date of Patent: Aug. 22, 2017

(54) SHOE HEEL DEVICE

(71) Applicant: Hyman Kramer, Bronx, NY (US)

(72) Inventor: Hyman Kramer, Bronx, NY (US)

( * ) Notice: Subject to any disclaimer, the term of this patent is extended or adjusted under 35 U.S.C. 154(b) by 0 days.

(21) Appl. No.: 14/682,446

(22) Filed: Apr. 9, 2015

(65) Prior Publication Data

US 2015/0289588 A1 Oct. 15, 2015

Related U.S. Application Data

(63) Continuation-in-part of application No. 14/595,681, filed on Jan. 13, 2015, now Pat. No. 9,603,413, which is a continuation of application No. 14/334,278, filed on Jul. 17, 2014, now Pat. No. 8,984,771.

(30) Foreign Application Priority Data

Apr. 10, 2014 (CN) ..... 2014 1 0141084

(51) Int. Cl.

| | |
|---|---|
| ***A43B 13/18*** | (2006.01) |
| ***A43B 13/14*** | (2006.01) |
| ***A43B 21/26*** | (2006.01) |
| ***A43B 7/24*** | (2006.01) |

(52) U.S. Cl.

CPC ..... *A43B 13/181* (2013.01); *A43B 7/24* (2013.01); *A43B 13/14* (2013.01); *A43B 13/141* (2013.01); *A43B 13/18* (2013.01); *A43B 13/186* (2013.01); *A43B 21/26* (2013.01)

(58) Field of Classification Search

CPC ..... A43B 21/26; A43B 21/32; A43B 13/18; A43B 13/00; A43B 13/14; A43B 13/184

USPC ..... 36/25 R, 28, 34 R, 35 R, 37, 61

See application file for complete search history.

(56) References Cited

U.S. PATENT DOCUMENTS

| | | | | | |
|---|---|---|---|---|---|
| 1,165,235 | A | | 12/1915 | Emery | |
| 1,718,906 | A | * | 6/1929 | Hurley | A43B 21/32 36/37 |
| RE20,381 | E | | 5/1937 | Murray | |
| 2,350,362 | A | * | 6/1944 | Margolin | A43B 21/26 36/3 B |
| 2,423,753 | A | | 7/1947 | Brooks | |
| 2,464,251 | A | * | 3/1949 | Moody | A43B 21/26 36/35 B |
| 2,540,449 | A | | 2/1951 | Kaufmann | |
| 2,648,916 | A | | 8/1953 | Greissinger | |
| 2,844,833 | A | | 7/1958 | Odermatt | |
| 2,863,230 | A | | 12/1958 | Cortina | |
| 3,267,592 | A | | 8/1966 | Champion | |
| 4,616,431 | A | * | 10/1986 | Dassler | A43B 13/181 36/28 |
| 4,794,707 | A | * | 1/1989 | Franklin | A43B 7/14 36/107 |
| 4,887,367 | A | | 12/1989 | Mackness et al. | |
| 5,311,677 | A | * | 5/1994 | Mann | A43B 7/142 36/107 |
| 5,367,791 | A | * | 11/1994 | Gross | A43B 13/26 36/25 R |

(Continued)

OTHER PUBLICATIONS

International Search Report and Written Opinion for Application No. PCT/US14/47081 mailed Nov. 21, 2014.

*Primary Examiner* — Marie Bays
(74) *Attorney, Agent, or Firm* — Merchant & Gould P.C.

(57) ABSTRACT

Shoe heel devices comprising a longitudinally compressible and transversely expandable shock absorber within a bore.

15 Claims, 7 Drawing Sheets

(56) References Cited

U.S. PATENT DOCUMENTS 5,493,791 A 2/1996 Kramer
5,775,005 A 7/1998 McClelland
5,860,229 A 1/1999 Morgenstern
6,145,220 A * 11/2000 Johnson, Jr. ..... A43B 21/26 36/30 R
6,205,684 B1 3/2001 Snyder
6,519,874 B1 * 2/2003 Dean ..... A43B 7/1415 36/30 R
6,691,432 B2 * 2/2004 Masseron ..... A43B 13/184 36/141
6,874,251 B2 4/2005 Moretti
7,000,334 B2 * 2/2006 Gillespie ..... A43B 13/186 36/28
7,020,988 B1 * 4/2006 Holden ..... A43B 7/1425 36/141
7,200,955 B2 * 4/2007 Foxen ..... A43B 7/1425 36/25 R
8,220,182 B2 7/2012 Righetto
8,365,439 B2 * 2/2013 Koh ..... A43B 3/0047 36/15
8,607,475 B2 12/2013 Nakano
8,984,771 B1 * 3/2015 Kramer ..... A43B 13/14 36/28
2002/0092202 A1 * 7/2002 Masseron ..... A43B 13/184 36/28
2003/0061733 A1 4/2003 Karsten
2006/0117603 A1 6/2006 Park
2006/0156581 A1 * 7/2006 Holden ..... A43B 7/1425 36/29
2007/0277401 A1 * 12/2007 Young-Chul ..... A43B 13/12 36/30 R
2007/0294917 A1 * 12/2007 Holden ..... A43B 7/1425 36/29
2008/0313924 A1 12/2008 Righetto
2008/0313928 A1 * 12/2008 Adams ..... A43B 5/1633 36/103
2010/0139120 A1 6/2010 Manz et al.
2010/0251566 A1 * 10/2010 Nakano ..... A43B 21/26 36/28
2011/0219645 A1 * 9/2011 Koh ..... A43B 3/0047 36/36 R
2011/0225842 A1 9/2011 Lu
2012/0055048 A1 3/2012 Haupt et al.
2012/0085002 A1 4/2012 Healy et al.
2014/0082972 A1 3/2014 Jones
2015/0289588 A1 * 10/2015 Kramer ..... A43B 13/181 36/28

* cited by examiner

SHOE HEEL DEVICE

CROSS-REFERENCE TO RELATED APPLICATIONS

This application is a continuation-in-part application of co-pending U.S. patent application Ser. No. 14/595,681 entitled "CUSHIONING SOLE FOR FOOTWEAR" and filed on Jan. 13, 2015, which is a continuation of U.S. patent application Ser. No. 14/334,278 entitled "CUSHIONING SOLE FOR FOOTWEAR" and filed on Jul. 17, 2014 (Patented—U.S. Pat. No. 8,984,771), which claims the benefit of Serial No. 201410141084.0, filed on Apr. 10, 2014 in China, entitled "CUSHIONING SOLE FOR FOOTWEAR." To the extent appropriate, a claim of priority is made to the above-disclosed applications. Also, to the extent appropriate, the above-disclosed applications are hereby incorporated by reference in their entirety.

BACKGROUND

Gait varies from person to person depending on the biomechanical characteristics or other factors. FIG. 1 shows three typical manners in which the foot contacts the ground, from left to right, pronated, neutral/normal, and supinated. Briefly, in pronation the foot takes on a position in which most of the body weight is loaded onto the inner edge of the foot. On the contrary, in supination the foot takes on a position in which the body weight is loaded onto the outer edge of the foot.

From the biomechanical viewpoint, it is correct to rest the foot on the ground in the neutral manner. Excessive pronation or supination is the source of many lower extremity problems, including muscle tiredness, knee joint pain, tendinitis, ligament strain, and even neurological damage.

SUMMARY

In general terms, this application relates to shoe heel devices. In some embodiments, the shoe heel device includes a shock absorber at least partially disposed within a bore. In some embodiments the shock absorber includes a compressible material that compresses longitudinally while expanding transversely. In some embodiments, the shock absorber includes a flange to prevent the shock absorber from falling through the bore. In still other embodiments, the shoe heel devices include heel caps configured to work together with the shock absorber and the heel.

One aspect is a device for a shoe heel comprising a vertically disposed bore and a shock absorber, the bore comprising an interior surface, the shock absorber defined by a longitudinal component and a transverse component perpendicular to the longitudinal component; and comprising an elongated member, a relaxed state, and a compressed state; the elongated member comprising a compressible material; wherein at least a portion of the shock absorber is disposed longitudinally within the bore; and wherein in the compressed state the compressible material is compressed longitudinally and expanded transversely such that the compressible material applies pressure to the interior surface of the bore.

Another aspect is a device for a shoe heel comprising a vertically disposed bore, a heel cap, and a shock absorber, the shock absorber defined by a longitudinal component and a transverse component perpendicular to the longitudinal component, and comprising an elongated member, a relaxed state, and a compressed state; the elongated member comprising a compressible material; wherein at least a portion of the shock absorber is disposed longitudinally within the bore; and wherein at least at least a portion of the heel cap is aligned with the bore.

A further aspect is a device for a shoe heel comprising a heel cap, a vertically disposed bore, and a shock absorber, the bore comprising an interior surface, a bottom, and a flange that prevents the shock absorber from falling through the bottom of the bore; the shock absorber defined by a longitudinal component and a transverse component perpendicular to the longitudinal component, and comprising an elongated member, a relaxed state, and a compressed state; the elongated member comprising a compressible material; wherein at least a portion of the shock absorber is disposed longitudinally within the bore; wherein in the compressed state the compressible material is compressed longitudinally and expanded transversely such that the compressible material applies pressure to the interior surface of the bore; wherein the heel cap comprises a top surface, a bottom surface, and an opening extending between the top surface and the bottom surface; and wherein the elongated member extends through the opening and below the bottom surface of the heel cap when the shock absorber is in the relaxed state.

DETAILED DESCRIPTION

Figure 1:
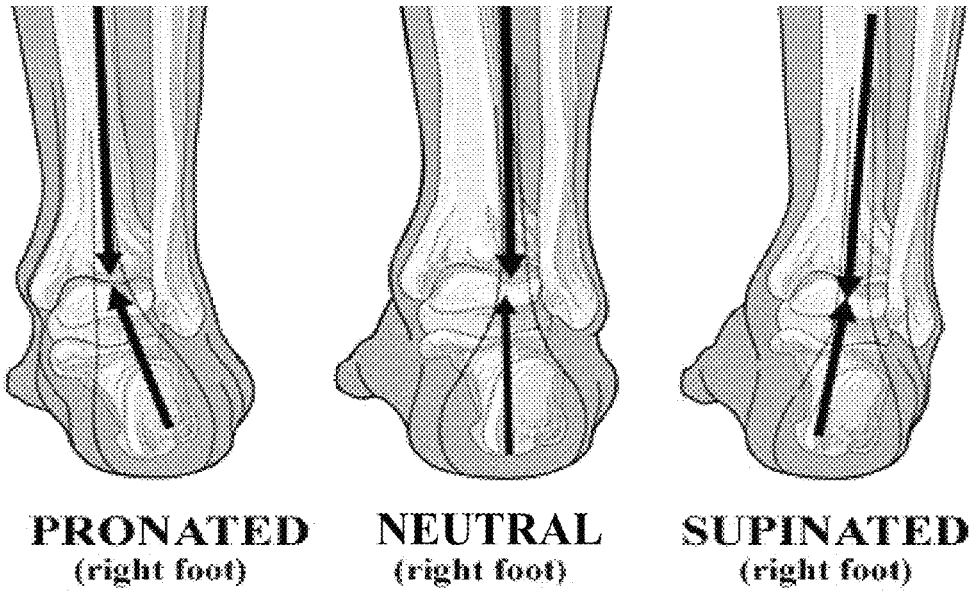
FIG. 1 is an illustrative example of a foot in pronated, neutral, and supinated positions.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. Furthermore, it should be noted that drawings and components are not necessarily drawing to scale. Relative dimensions of the representations of certain components in the drawings can vary without departing from the purpose or function of the present disclosures.

FIG. 1 is an illustrative example of a foot in pronated, neutral, and supinated positions. In pronation the foot takes on a position in which most of the body weight is loaded onto the inner edge of the foot. In contrast, in supination the foot takes on a position in which the body weight is loaded onto the outer edge of the foot. In a neutral position the body weight is distributed more evenly across the entire bottom of the foot.

Figure 2:
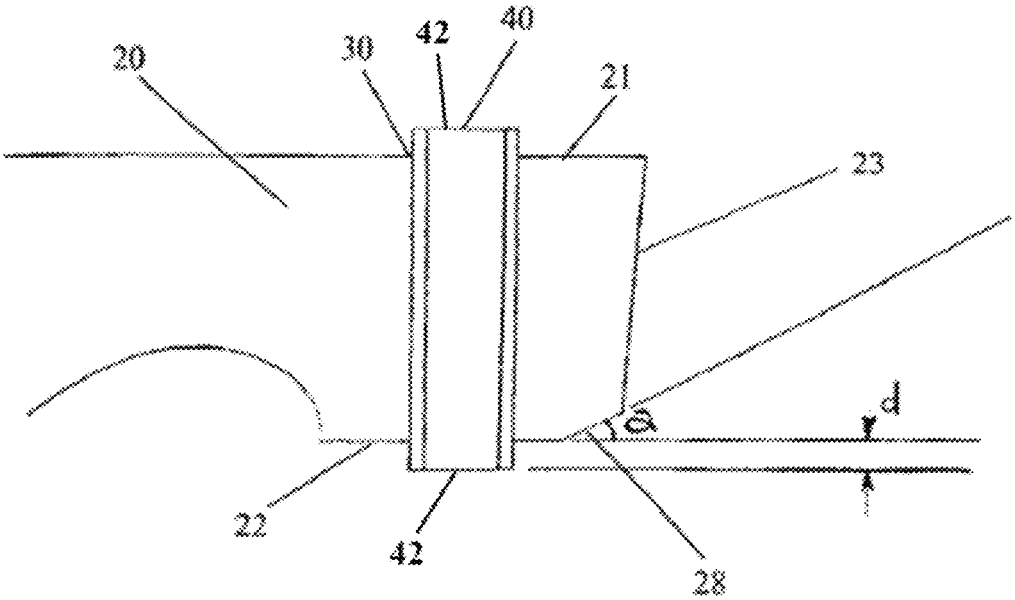
FIG. 2 illustrates a side view of the heel portion of the sole.

FIG. 2 illustrates a side view of the heel portion 20 of the sole of one embodiment of the present disclosure. In one embodiment, the sole comprises a heel portion 20 in which a bore 30 is formed, preferably at the center of the heel portion 20. A shock absorber 40 is inserted in the bore 30 in a manner such that the shock absorber 40 extends a distance beyond the bottom 22 and top 21 surfaces of the heel portion 20. In a preferred embodiment, during walking the extended shock absorber 40 always contacts the ground first. The sole bottom 22 begins to contact the ground only after the shock absorber 40 has been compressed. In this way, flexible material is allowed to be used in footwear while retaining stability and durability of the sole. The shock absorber 40, when contacting the ground and being compressed reduces the impact on the foot when the shoe contacts the ground and converts downward pressure applied by the wearer's weight to upward pressure which assists in walking and running. In addition, the shock absorber 40 helps the foot contact the ground at the correct location, thereby resisting pronation/supination.

A person having an excessive pronation/supination problem repeatedly puts his/her body weight on a side of the foot. As a result, the periphery of the heel portion 20 of the sole wears out quickly, causing a more severe problem. In preferred embodiments, to avoid this, the heel section 28 is formed at an angle $\alpha$ in the periphery of the heel portion 20 with respect to its bottom surface 22. It is desirable to incorporate an angle $\alpha$ in the whole back 23 lower end of the heel portion 20. The angle $\alpha$ is an angle greater than 0 degrees and less than 90 degrees. In some embodiments the angle $\alpha$ is in a range from about 10 degrees to about 60 degrees. In other embodiments the angle $\alpha$ is in a range from about 20 degrees to about 50 degrees.

In alternative embodiments, the heel lacks a support element and does not contain a bore for receiving that element. In these embodiments, the sole still contains the heel section 28 formed at an angle $\alpha$ in the periphery of the heel portion 20 with respect to its bottom surface 22. Without wishing to be bound to any particular theory, it is believed that heel section 28 can correct excessive pronation/supination problem all by itself, and that a support element, e.g., shock absorber 40, is optional.

The distance d that the shock absorber 40 extends beyond the bottom 22 surface of the heel portion 20 in a relaxed state should be within a suitable range. If the distance d is too small, the shock absorber 40 may not be able to separate the heel portion 20 of the sole from the ground after a long period of walking. If the distance d is too large, the wearer may experience an uncomfortable feeling. In one embodiment, the distance d is in a range from about 1/16 inch to about 1/4 inch, or alternatively about 1/8 inch to retain the function of the shock absorber 40 for an extended period without causing an uncomfortable feeling.

The shock absorber 40 in some embodiments is made of plastic, rubber or other cushioning materials. The shock absorber 40 can be formed into different shapes, which can include, but are not limited to, a cylinder, prism or cone. The example shown in FIG. 2 includes a cylindrically shaped shock absorber 40. Other embodiments include, for example, rectangular, elliptical, and other cross-sectional shapes. The bore 30 typically has a cross-sectional shape that matches the cross-sectional shape of the shock absorber 40. As such, the bore may also have, e.g., a cylindrical, rectangular, elliptical or other cross-sectional shape. The bore may be made of the same material that makes up the shoe heel itself, i.e., the bore is an opening in a shoe heel, or may be of a different material than can be inserted into an opening in the shoe heel. In some embodiments corners and edges are rounded to reduce pressure points and to reduce the chance of catching on another object.

In some embodiments, the shock absorber 40 is slideably retained in the heel portion 20 and is not permanently secured to the heel portion 20. In this way the shock absorber is slidable within the bore 30 and can be replaced when worn out. Additionally, in some embodiments the shock absorber 40 can be made with open ends 42 (FIG. 2) so that it can be filled with a flexible material to absorb shock in a more efficient way.

As can be seen from FIG. 2, in this example the upper end of the shock absorber 40 also extends beyond the top surface 21 of the heel portion 20. The resistant force of the compressed shock absorber 40 acts on the wearer's heel, helping the wearer to walk easily.

Figure 3:
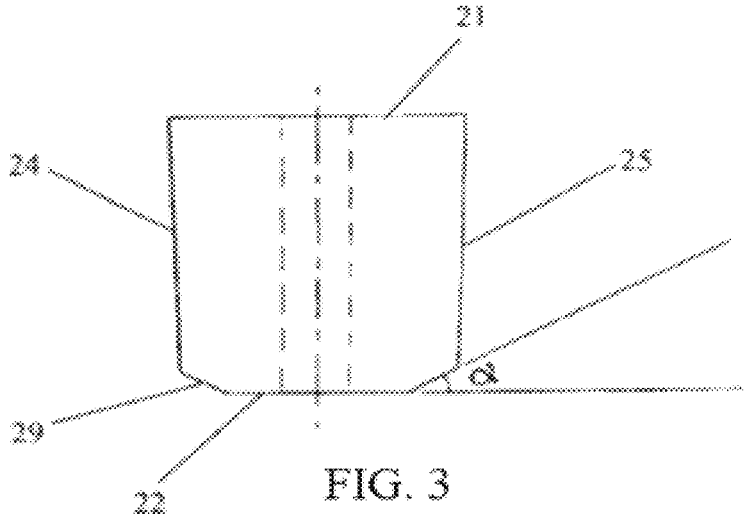
FIG. 3 is a rear view of the sole.

FIG. 3 is a rear view of the sole. In some embodiments, the left rear wall 24 and the right rear wall 25 of the heel portion 20 are also angled with an angle $\alpha$ in a tapered configuration with respect to the bottom 22 surface to avoid wear of the sole. In one embodiment, the tapered configuration 29 is applied around the whole bottom 22 heel portion 20 of the sole, including the front portion, so that the edges of the footwear do not touch the ground. In other embodiments, the tapered configuration is applied to the entire bottom 22 of heel portion 20 of the sole and also to the front portion of the sole.

Figure 4:
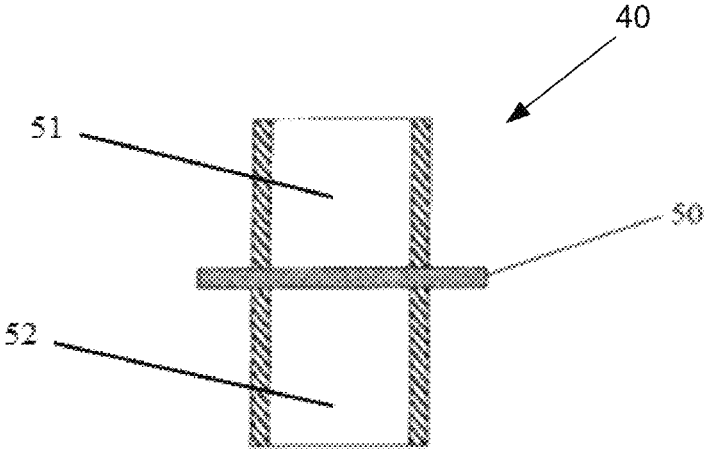
FIG. 4 is a cross-sectional view of a shock absorber, comprising an upper part and a lower part connected by a strip.

FIG. 4 is a cross-sectional view of one embodiment of the shock absorber 40, comprising an upper portion 51 and a lower portion 52 connected by a substrate. In this example, the substrate is a strip 50. In some embodiments, the strip 50 has at least one cross-sectional dimension greater than the upper portion 51 and the lower portion 52 extending into the sides of the bore 30 (FIG. 2). The strip 50 is used to support the shock absorber 40 within the bore 30 (FIG. 2) and prevent it from moving. In some embodiments the upper portion 51 and the lower portion 52 of shock absorber 40 are formed of a cushioning material, while the strip 50 is formed of either a cushioning material or a rigid material. In other embodiments, the upper portion 51 and the lower portion 52 of shock absorber 40 are formed of a rigid material, while the strip 50 is formed of a cushioning material to provide the cushioning for the shock absorber 40. The cushioning material is a material with at least greater flexibility than the rigid material.

Figure 5:
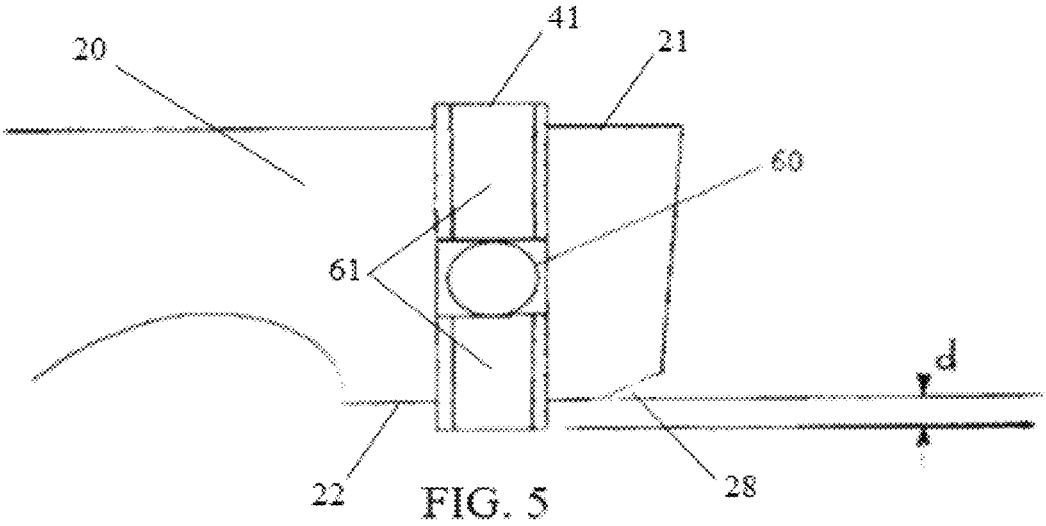
FIG. 5 illustrates a side view of the heel portion of the sole according to another embodiment of the present disclosure.

FIG. 5 is a side view of another embodiment of the present disclosure. The shock absorber 41 comprises two upper and lower portions 61 separated by a substrate 60. In some embodiments, the substrate 60 is a flexible substrate. The upper and lower portions 61 respectively extend beyond the top surface 21 and the bottom surface 22 of the heel portion 20 when the shock absorber is in a relaxed state (e.g., when no downward pressure is being applied by the user's foot). The physical property of the flexible substrate 60 can be adjusted according to different ground conditions. The use of flexible substrate 60 increases the compact resistance in a controlled way and further stabilizes the foot.

Some embodiments include a plurality of flexible substrates having different flexibilities. Also, in some embodiments at least one of the upper and lower portions is/are removable. The flexible substrates are replaceable within the bore to permit selective insertion of a flexible substrate having a desired flexibility according to the conditions or preferences of the wearer.

The distance d that the shock absorber 41 extends beyond the bottom surface 22 of the heel portion 20 should be within a suitable range. If the distance d is too small, the shock absorber 41 may not be able to separate the heel portion 20 of the sole from the ground after a long period of walk. If the distance d is too large, the wearer may experience an uncomfortable feeling. In one embodiment, the distance d is in a range from about 1/16 inch to about 1/4 inch, or alternatively about 1/8 inch to retain the function of the shock absorber 41 for an extended period without causing an uncomfortable feeling.

Figure 6:
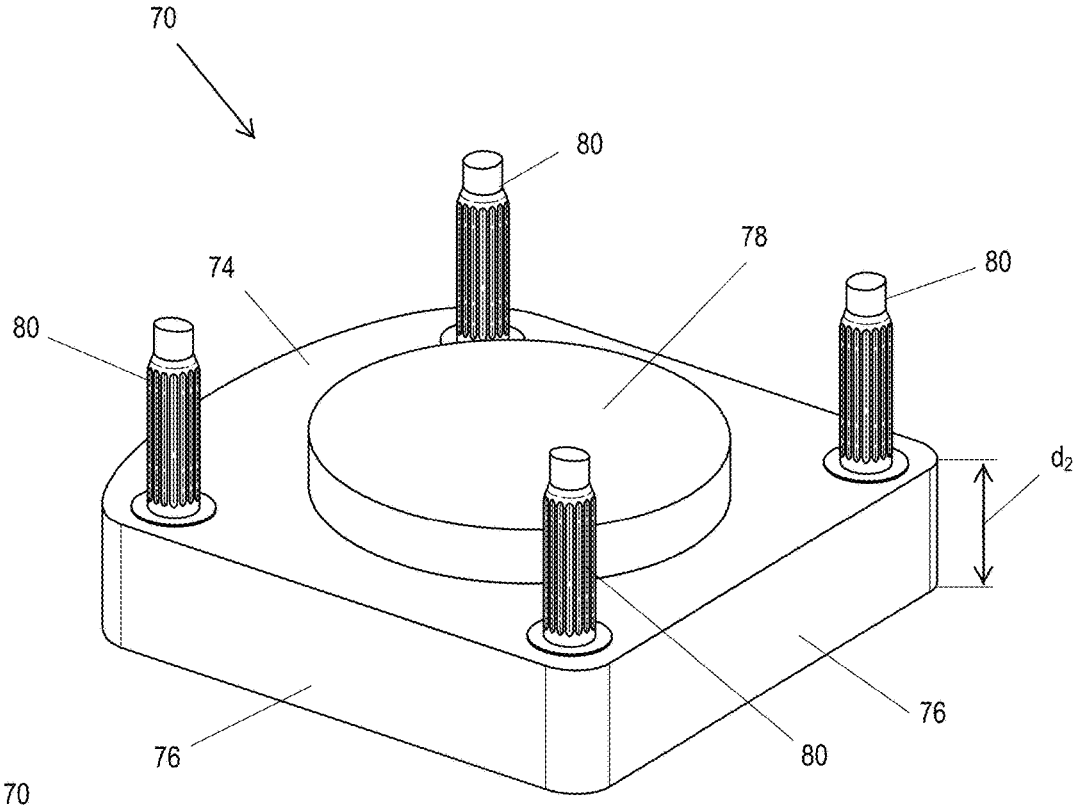
FIG. 6 is a top perspective view of an embodiment of a heel cap in accordance with the present disclosure.
Figure 7:
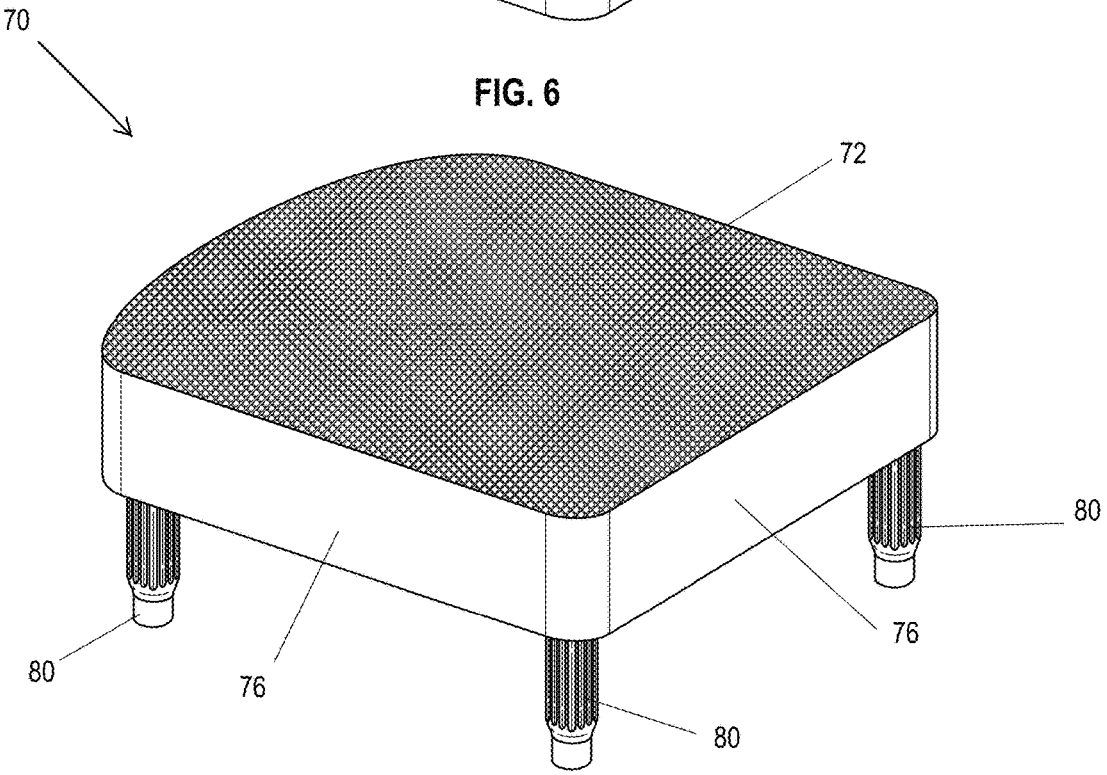
FIG. 7 is a bottom perspective view of the heel cap of FIG. 6.

FIG. 6 is a top perspective view of an embodiment of a heel cap in accordance with the present disclosure; FIG. 7 is a bottom perspective view of the example heel cap of FIG. 6. As shown in FIGS. 6-7, example heel cap 70 includes a bottom surface 72, a top surface 74, side surfaces 76, raised portion 78, and pegs 80.

Figure 13:
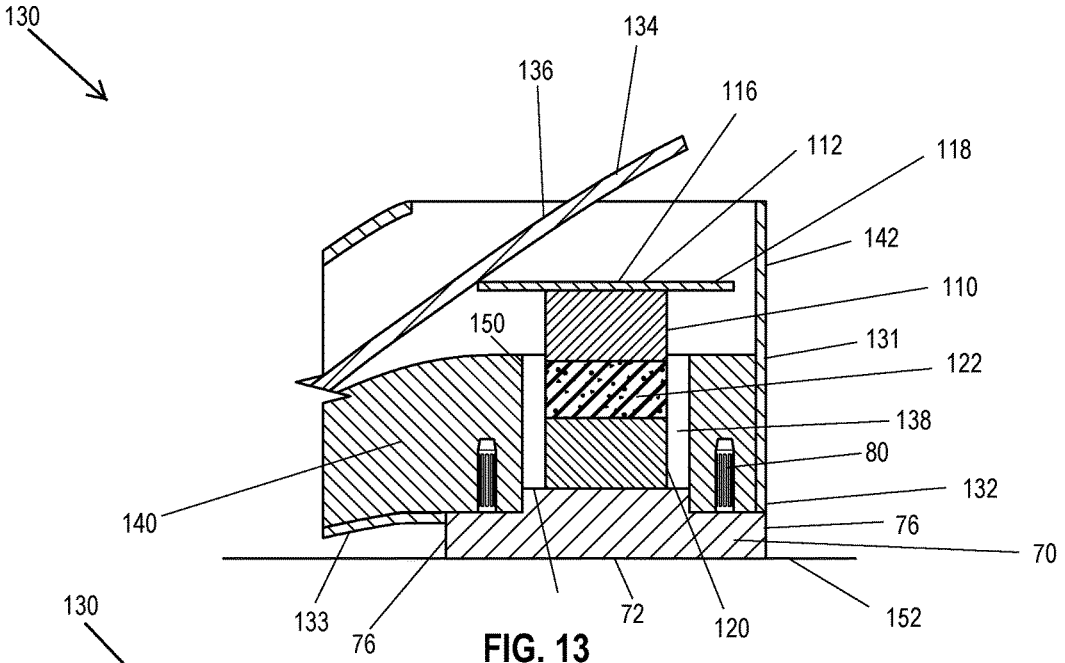
FIG. 13 is a schematic, side, cross-sectional view of the rear portion of the shoe, shock absorber, and heel cap combination of FIG. 12.

Example heel cap 70 can be secured to the bottom of the heel portion of a shoe to reinforce the heel and protect the heel from wear and tear associated with continued use. Heel cap 70 is placed on the heel such that the bottom surface 72 contacts the ground. When secured to the bottom of the shoe, the top surface 74 of the heel cap 70 abuts the bottom of the shoe heel. The side surfaces 76 extend between the top surface 74 and the bottom surface 72. In different embodiments, one or more of the side surfaces 76 or one or more portions thereof are flat and/or alternatively rounded. Alternatively, the side surfaces 76 are contoured to match the contour of the adjacent heel against which the heel cap 70 is secured. Side surfaces 76 include a thickness $d_2$. Thickness $d_2$ is sufficient to withstand a desirable amount of wear and tear without damaging the heel against which the heel cap 70 is secured. In addition, or alternatively, $d_2$ is determined based on the desired distance by which the shock absorber 110 extends above the bore (such as the bore 30 described above or bore the 138 described below; FIG. 13) when in a relaxed state. In addition, or alternatively, $d_2$ is selected to provide a desirable amount of elevation to the shoe, such as in the case of high heeled shoes. In some examples, $d_2$ is in a range from about 1 mm to about 50 mm. In other examples, $d_2$ is about 9 mm. In other examples, $d_2$ falls outside of these ranges and values.

In some example embodiments, one or more of the side surfaces 76 or one or more portions thereof are angled consistent with the above description of FIGS. 2-3 in order to further aid in the correction of gait conditions such as pronation or supination by encouraging the heel of the foot to land squarely (i.e. neutrally) rather than at an angle to the ground. In some embodiments, $d_2$ varies between different parts of the heel cap 70. For example $d_2$ may vary such that the heel cap 70 is thicker towards the back of the shoe and thinner towards the front of the shoe (or vice versa) when the heel cap 70 is secured to the heel of the shoe.

The raised portion 78 is optional, and is configured to extend into a bore (such as bore 30 described above or a bore 138 described below) in the heel of the shoe and thereby provide a platform upon which a shock absorber can rest and compress against, as will be discussed in greater detail below in connection with FIG. 13. The height of the raised portion 78 above the top surface 74 may be within a suitable range. For example, the height of the raised portion 78 may be based on a size of the footwear, a weight of the user of the footwear, an intended use of the footwear, a medical condition of the user, and/or the desired distance by which the shock absorber 110 extends above the bore when in a relaxed state. The raised portion 78 can be any suitable shape. In the example shown, raised portion 78 is cylindrical and configured to fit within a correspondingly round bore in the heel of the shoe. In alternative examples, the heel cap 70 does not include a raised portion 78, and instead has a flat top surface 74 uninterrupted except by one or more fasteners such as pegs 80.

Heel cap 70 can be removeably and replaceably secured (such as after significant wear and tear) to the bottom of the heel of a shoe with one or more pegs 80 or other suitable fastening means, such as nails, screws, staples, pins, stitches, glue, and so forth. The number and configuration/placement of pegs 80 or other fasteners is not limited by the example shown in FIGS. 6-7. The one or more pegs 80 or other fasteners can be inserted into, or otherwise secured to, the material at the bottom of the outsole of the shoe, thereby securing the heel cap 70 to the bottom of the shoe.

Securing a heel cap such as the heel cap 70 to the heel of a shoe below a shock absorber prevents the shock absorber from undesirably falling out of the shoe. In addition, by covering the shock absorber, the heel cap 70 protects the shock absorber from damage that might otherwise be caused by the shock absorber's direct contact with the ground.

Example heel cap 70 can be manufactured from any suitably strong and durable material, such as rubber, plastic, wood, leather, metal, and so forth.

Figure 8:
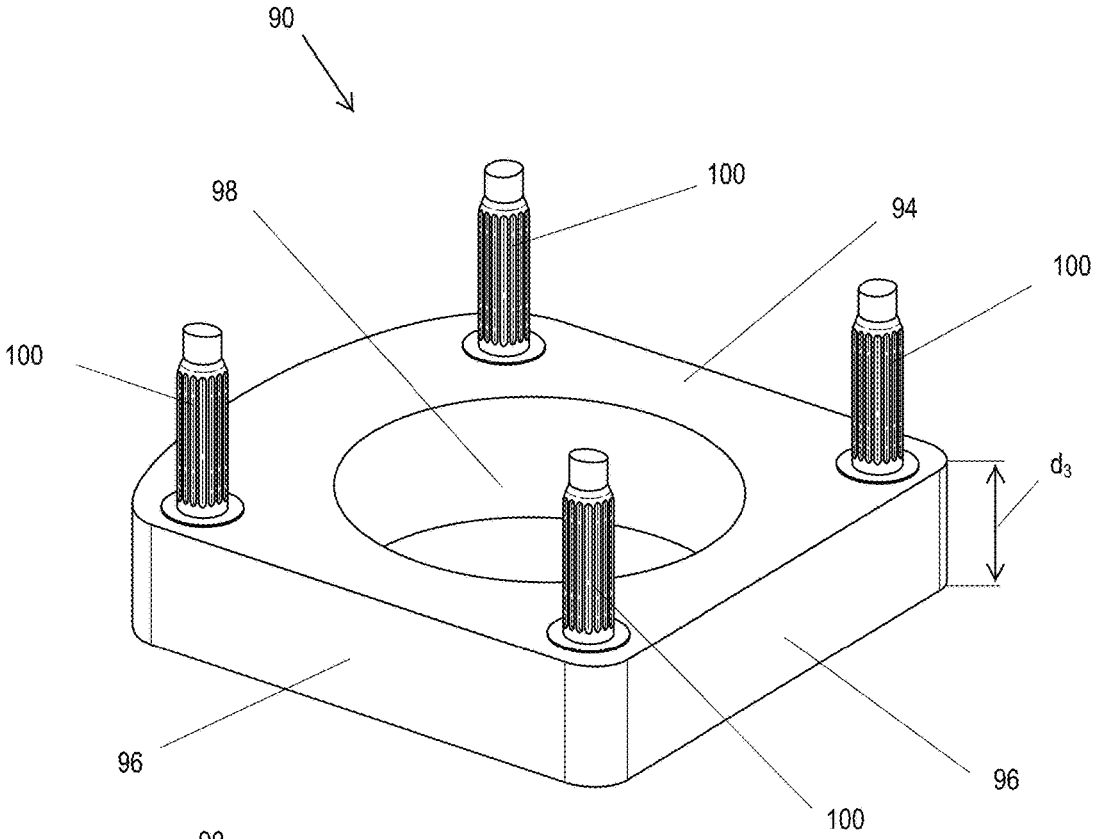
FIG. 8 is a top perspective view of a further embodiment of a heel cap in accordance with the present disclosure.
Figure 9:
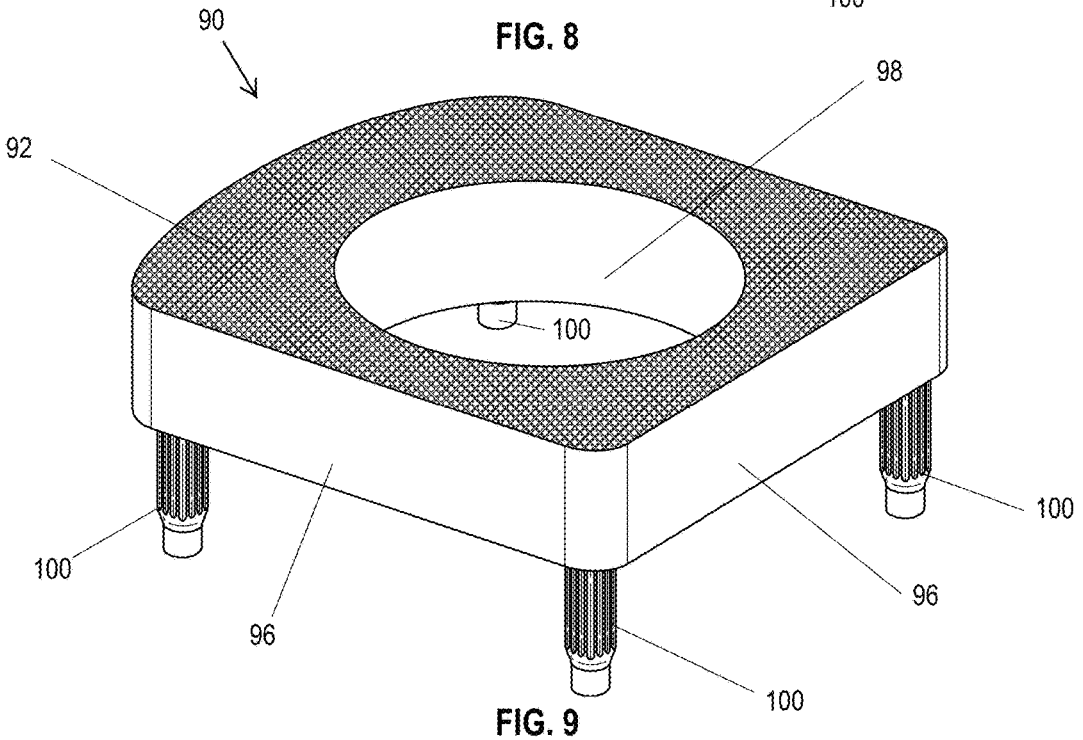
FIG. 9 is a bottom perspective view of the heel cap of FIG. 8.

FIG. 8 is a top perspective view of a further embodiment of a heel cap in accordance with the present disclosure; FIG. 9 is a bottom perspective view of the example heel cap of FIG. 8. As shown in FIGS. 8-9, example heel cap 90 includes a bottom surface 92, a top surface 94, side surfaces 96, opening 98, and pegs 100.

Figure 14:
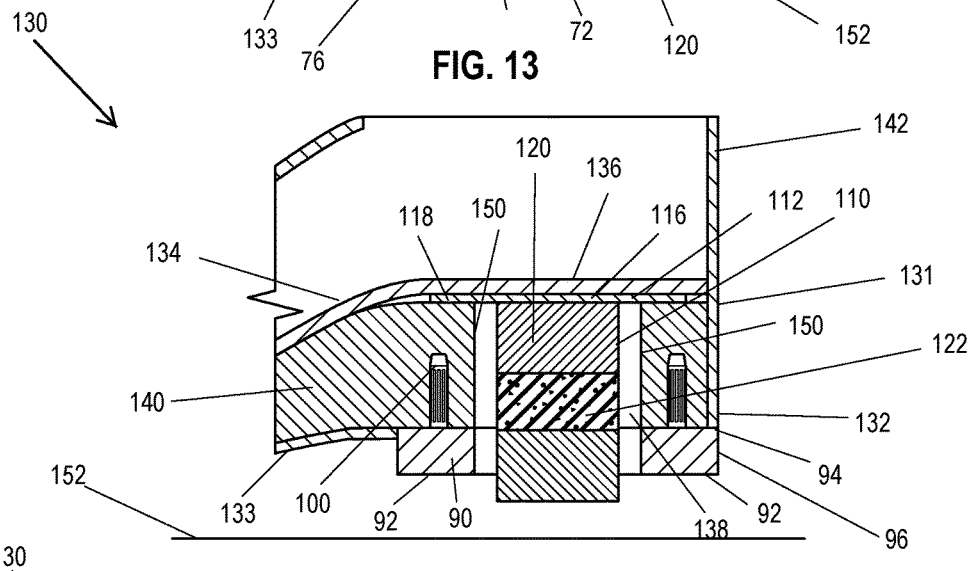
FIG. 14 is a schematic, side, cross-sectional view of the rear portion of a shoe including the shock absorber of FIG. 10 in a relaxed state, and the heel cap of FIG. 8.

Example heel cap 90 can be secured to the bottom of the heel portion of a shoe to reinforce the heel and protect the heel from wear and tear associated with continued use. Heel cap 90 is placed on the heel such that the bottom surface 92 contacts the ground upon sufficient downward pressure to compress a shock absorber as described in more detail below. When secured to the bottom of the shoe, the top surface 94 of the heel cap 90 abuts the bottom of the shoe heel. The side surfaces 96 extend between the top surface 94 and the bottom surface 92. In different embodiments, one or more of the side surfaces 96 or one or more portions thereof are flat and/or alternatively rounded. Alternatively, the side surfaces 96 are contoured to match the contour of the adjacent heel against which the heel cap 90 is secured. Side surfaces 96 include a thickness $d_3$. Thickness $d_3$ is sufficient to withstand a desirable amount of wear and tear without damaging the heel or outsole against which the heel cap 90 is secured. In addition, or alternatively, $d_3$ is determined based on the distance the lower portion of the shock absorber 110 extends beyond the lower surface of the shoe (FIG. 14). In addition, or alternatively, $d_3$ is selected to provide a desirable amount of elevation to the shoe, such as in the case of high heeled shoes. In some examples, $d_3$ is in a range from about 1 mm to about 50 mm. In other examples, $d_3$ is about 9 mm. In other examples, $d_3$ falls outside of these ranges and values.

In some example embodiments, one or more of the side surfaces 96 of the heel cap 90 or one or more portions thereof are angled consistent with the above description of FIGS. 2-3 in order to further aid in the correction of gait conditions such as pronation or supination by encouraging the heel of the foot to land squarely (i.e. neutrally) rather than at an angle to the ground. In some embodiments, $d_3$ varies between different parts of the heel cap 90. For example, $d_3$ may vary such that the heel cap 90 is thicker towards the back of the shoe and thinner towards the front of the shoe (or vice versa) when the heel cap 90 is secured to the heel of the shoe.

The opening 98 extends through the entire thickness $d_3$ of the heel cap 90 and is configured to receive a portion of the bottom of a shock absorber (such as the shock absorber 40 described above or the shock absorber 110 described below). In this manner, opening 98 permits a shock absorber to extend beyond the bottom of the shoe heel and the heel cap 90 and contact the ground directly, as will be discussed further in connection with FIGS. 14-15. The opening 98 can be any suitable shape, and need not match the shape of the shock absorber or the bore. The opening 98 may be formed preferably at the center of heel cap 90 and aligned with the heel of the shoe. The width of the opening 98 may be determined based on dimensions of the shock absorber 110. In the example shown, the opening 98 is round and configured to receive a correspondingly round or cylindrical shock absorber.

Heel cap 90 can be removeably and replaceably (such as after significant wear and tear) secured to the bottom of the heel of a shoe with one or more pegs 100 or other suitable fastening means, such as nails, screws, staples, pins, stitches and the like. The number and configuration of pegs 100 or other fasteners is not limited by the example shown in FIGS. 8-9. The one or more pegs 100 or other fasteners can be inserted into, or otherwise secured to, the material at the bottom of the heel portion or outsole of the shoe, thereby securing the heel cap 90 to the bottom of the shoe.

The example heel cap 90 is manufactured from any suitably strong and durable material, such as rubber, plastic, wood, leather, metal, and so forth.

Figure 10:
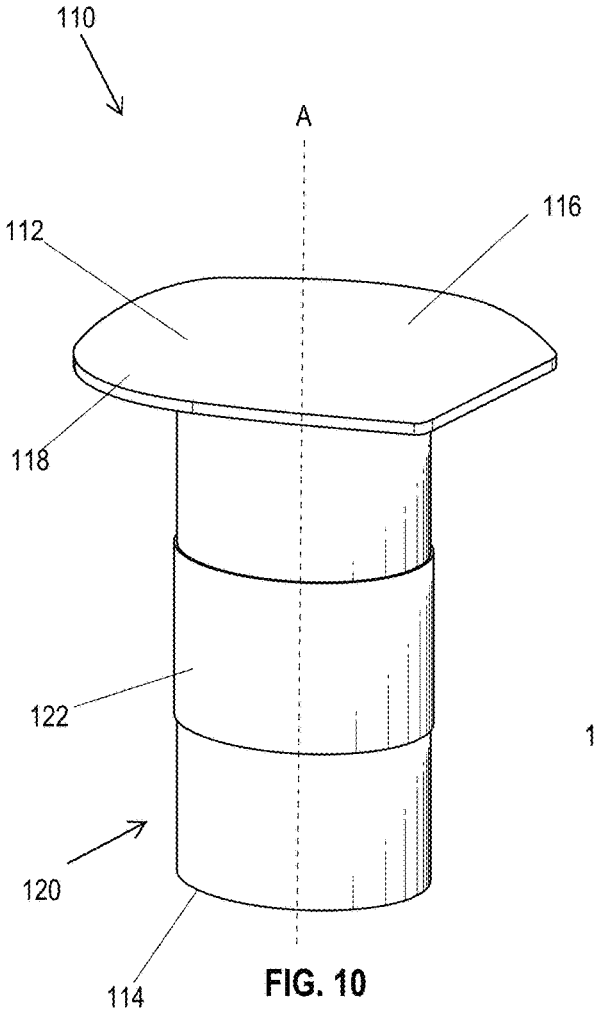
FIG. 10 is a top perspective view of an embodiment of a shock absorber in accordance with the present disclosure illustrating the shock absorber in a relaxed state.
Figure 11:
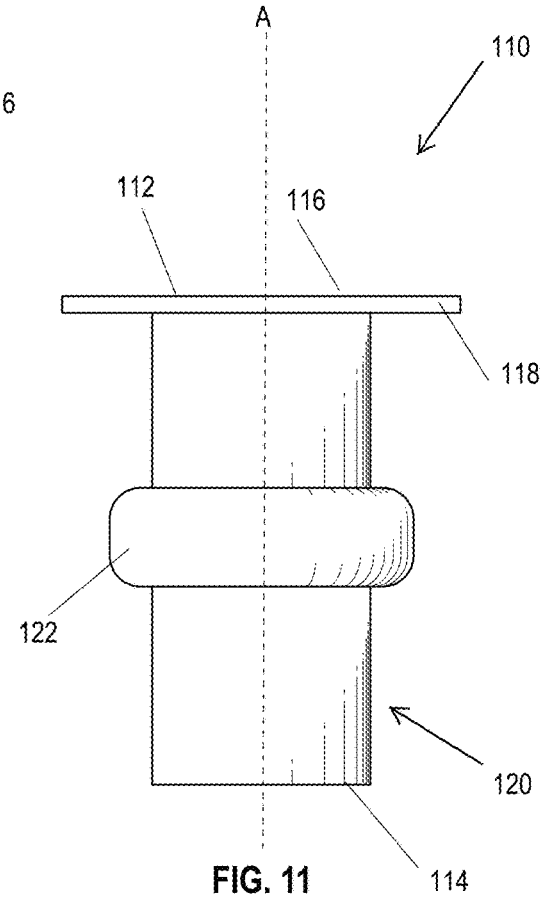
FIG. 11 is a side view of the shock absorber of FIG. 10 illustrating the shock absorber in a compressed state.

FIG. 10 is a top perspective view of an embodiment of a shock absorber 110 in accordance with the present disclosure illustrating the shock absorber in a relaxed state; FIG. 11 is a side view of the shock absorber 110 of FIG. 10 illustrating the shock absorber in a compressed state. As shown in FIGS. 10-11, an example shock absorber 110 includes a top 112, a bottom 114, an optional upper plate 116, an optional flange 118, an elongated member 120, and a compressible material 122. The shock absorber 110 is defined by a longitudinal axis A from which the various aspects of the shock absorber 110 extend transversely outward.

The example shock absorber 110 is configured to be housed in a bore (such as the bore 30 discussed above or the bore 138 discussed below) in the heel of a shoe, such that the top 112 of the shock absorber 110 is disposed below or near the insole of the shoe, and the bottom 114 of the shock absorber 110 is disposed within or below the heel of the shoe. The optional upper plate 116 is disposed at the top 112 of the shock absorber 110 and, optionally, has a flange 118 that extends transversely outward beyond at least a portion of the elongated member 120. The flange 118 of the upper plate 116 is configured to extend beyond the top edge of the bore (such as the bore 30 discussed above or the bore 138 discussed below). In some embodiments, when the shock absorber 110 is in a compressed state, the flange 118 rests on the top of a floor plate in a shoe. In alternative embodiments, when the shock absorber 110 is in compressed state, the flange 118 rests on the top of an insole in a shoe. In yet further alternative embodiments, when the shock absorber 110 is in a compressed state, the flange 118 rests on an upper portion of the outsole of a shoe. In still further alternative embodiments, the flange 118 rests on any of the shoe components just described even when the shock absorber 110 is in a relaxed state (as shown in FIG. 10, for example). The flange 118 thus prevents the shock absorber 110 from falling through the opening in the heel of the shoe. The upper plate 116 can be any suitable shape such as square, rectangular, triangular, round, irregular, or otherwise, without departing from its purpose and function. In some embodiments, the upper plate 116 is sufficiently thin so as to be undetectable or substantially undetectable by the user's foot when the foot applies pressure on the shock absorber 110. In alternative embodiments the upper plate is thick enough to be detectable under the foot.

The elongated member 120 extends downward from the upper plate 116. The elongated member 120 can be any suitable shape. In this embodiment the elongated member 120 is cylindrical and configured to be received by a correspondingly cylindrical bore in the heel of a shoe. In some embodiments, the elongated member 120 in a relaxed state is longer along longitudinal axis A than the thickness of the shoe heel in which it is housed. In some embodiments, a portion towards the top of the elongated member 120 (i.e. the portion adjacent the top 112 of the shock absorber 100) extends above the top of the outsole of a shoe when the elongated member is in a relaxed state. In yet further embodiments, a portion towards the bottom of the elongated member 120 (i.e. the portion adjacent the bottom 114 of the elongated member 120) extends below the bottom of the heel of the shoe when the elongated member 120 is in relaxed state. In still further embodiments, a portion towards the top of the elongated member 120 extends above the top of the outsole of a shoe and a portion towards the bottom of the elongated member 120 extends below the bottom of the heel of the shoe when the elongated member 120 is in a relaxed state. When the elongated member 120 is in a compressed state (as shown in FIG. 11, for example), in some embodiments the elongated member 120 is entirely contained within the heel of a shoe; in alternative embodiments, one or both of the top portion of the elongated member 120 and the bottom portion of the elongated member 120 extends beyond the top of the outsole of the shoe or the bottom of the heel, respectively.

The elongated member 120 includes a compressible material 122. The compressible material 122 allows the shock absorber 110 to compress along its longitudinal axis A when force is exerted along that axis, such as the force of a foot pressing down on the upper plate 116 of the shock absorber 110. The compressible material 122 can be disposed at any location along longitudinal length of the elongated member 120. In some embodiments, the entirety of the elongated member 120 is the compressible material 122. In other embodiments, only a portion of the elongated member 120 is the compressible material 122. In such embodiments, the compressible material 122 can disposed near the top of the elongated member 120, near the bottom of the elongated member 120 or somewhere in the middle, as shown in the example shock absorber 110 in FIG. 10.

The compressible material 122 is selected from materials (or a combination of materials) that reduce in volume when pressure is applied and return to their full volume, or near full volume, uncompressed state when that pressure is released. A non-limiting example of a suitable compressible material 122 is a closed-cell polyurethane foam rubber.

In some embodiments, the compressible material 122 is selected such that when it is compressed along the longitudinal axis A of the shock absorber 110, at least a portion of the compressible material 122 expands transversely outward away from axis A, as shown in FIG. 11. Outward transverse expansion of the compressible material 122 results in a transverse force or pressure on the wall(s) of the bore (such as the bore 30 described above or the bore 138 described below) in the shoe, corresponding to transverse dissipation of the perpendicular vertical force applied by the foot when taking a step. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 described above or bore 138 described below) in response to the transverse expansion of the compressible material 122 also enhances the shock absorbing characteristics of the shock absorber 110, and also enhances the shock absorber's ability to correct for excessive supination or pronation of the gait.

Figure 12:
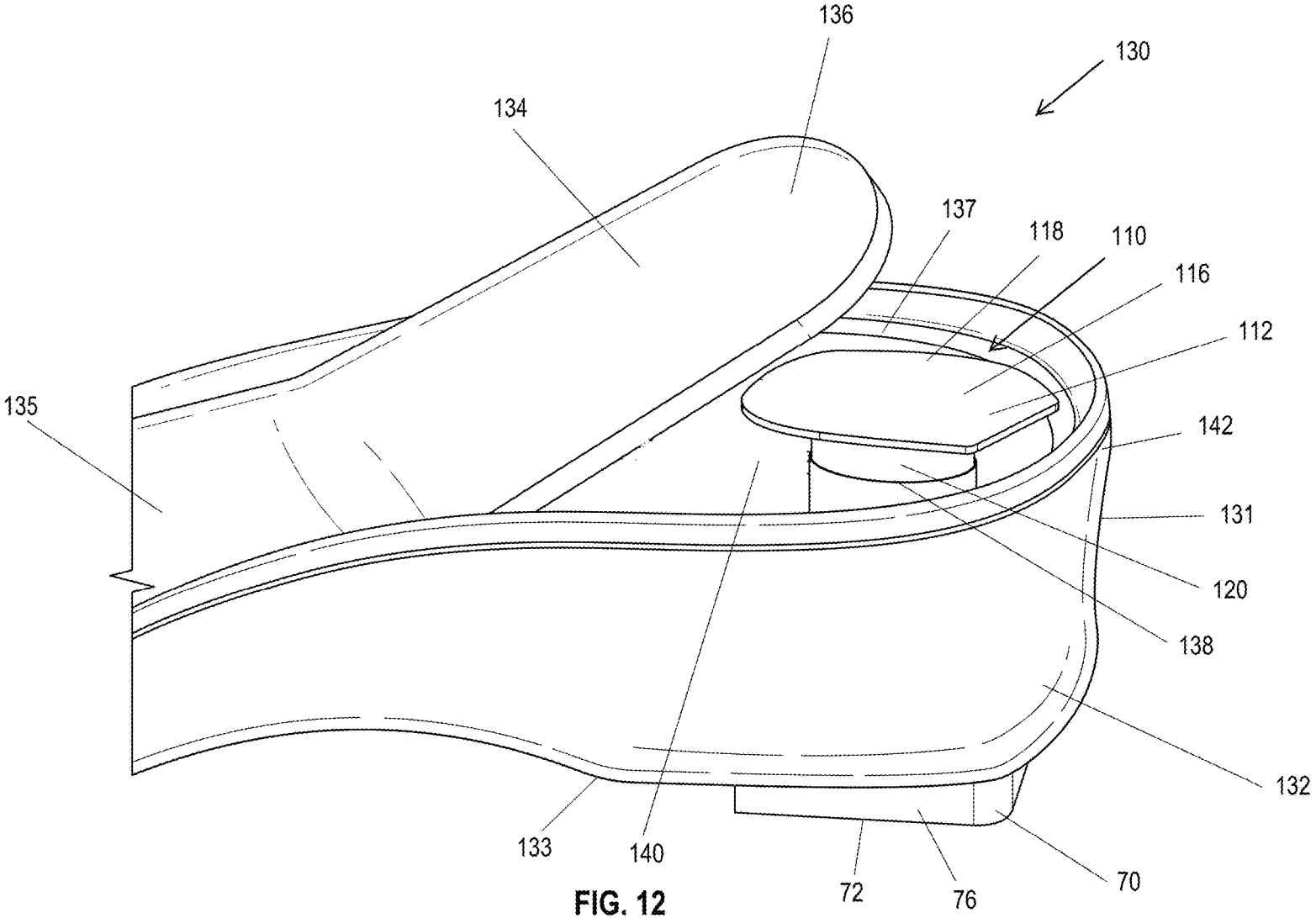
FIG. 12 is a top schematic perspective view showing portions of the rear part of a shoe including the shock absorber of FIG. 10 and the heel cap of FIG. 6.

FIG. 12 is a top schematic perspective view showing portions of the rear part of a shoe including the shock absorber 110 of FIG. 10 and the heel cap 70 of FIG. 6. The shoe 130 includes a heel cap 70, with its bottom surface 72 and its side surfaces 76, as discussed above. In addition, the shoe 130 includes a shock absorber 110, having a top 112, upper plate 116, flange 118, and elongated member 120 as discussed above. In this example, the shoe 130 also includes a rear end 131, a heel portion 132, an outsole bottom 133, a floor plate 134 having a front portion 135 and rear portion 136, a support ledge 137, a bore 138, a support system 140; and the heel portion 132 has a top 142.

As shown in FIG. 12, the heel cap 70 is secured to the shoe 130 towards its rear end 131 under the heel portion 132 on the outsole bottom 133 of the shoe 130. Fasteners (such as the pegs 80 described above in connection with FIG. 6) are embedded in the support system 140 to secure the heel cap 70 to the heel portion 132.

The floor plate 134 of the shoe 130 provides a substantially firm surface on which to place an insole, for example. Alternatively, the user's foot can be placed directly on the floor plate 134. In this example, a front portion 135 of the floor plate 134 is secured to the shoe through conventional fastening means, such as staples, nails, glue and so forth, while a rear portion 136 of the floor plate 134 is not secured to the shoe 130, thereby allowing the elongated member 120 to expand upwards (i.e. away from the heel cap 70) into its relaxed state by pushing upwards on the rear portion 136 of the floor plate 134. In this embodiment, the floor plate 134, where secured to the shoe, is fastened onto the support ledge 137 which lines a perimeter of the shoe 130.

The bore 138 is disposed vertically within the support system 140 that occupies at least some of the space between the top 142 of the heel portion 132 and the outsole bottom 133 of the shoe 130. In some embodiments the bore 138 is aligned with the heel cap 70. The elongated member 120 of the shock absorber 110 is disposed within the bore 138, with the bottom 114 of the shock absorber (see FIG. 10) resting against the raised portion 78 (see FIG. 6) of the heel cap 70. The raised portion 78 (FIG. 6) elevates the shock absorber 110 in its relaxed state relative to its position in its compressed state, thereby allowing for a greater degree of vertical compression along axis A (FIG. 11) for enhanced shock absorbing characteristics. Thus, with specific reference to the embodiment shown in FIG. 12, the raised portion 78 (FIG. 6) of the heel cap 70 increases the distance by which the shock absorber 110 extends above the support ledge 137 when the shock absorber 110 is in its relaxed state. A depth of the bore 138 and a longitudinal length of the shock absorber 110 may be determined based on one or more parameters such as a size of the footwear, a weight of the user of the footwear, an intended use of the footwear, and a medical condition of the user.

The support system 140 can include any material, materials, or configuration of one or more materials and/or structures sufficient to provide for a bore 138 having a rigid interior surface as described below. In some embodiments, the support system 140 includes a tube or other hollow structure in which the bore 138 is disposed. In some embodiments the support system 140 is an integral part of the heel portion 132 and/or the outsole of the shoe. In some embodiments, the support system is configured to support fasteners that secure the heel cap 70 to the heel portion 132. In some embodiments, the support system 140 is configured to support the elements of the shoe that rest on the support system 140 for support. In some embodiments, such elements can include, by way of non-limiting examples, the floor plate 134, the flange 118 of the shock absorber 110 when the shock absorber 110 is in a compressed state, an insole, the support ledge 137, and the weight of a person's foot. In some embodiments, the support system 140 is continuous and solid throughout. In other embodiments the support system 140 is discontinuous and/or contains one or more cavities of empty space to reduce the overall weight of the shoe 130.

In alternative embodiments to that shown in FIG. 12, the bore 138 extends through an opening in the floor plate 134 and the shock absorber 110 extends above the floor plate 134 (e.g. through an opening in the rear portion 136 of the floor plate 134), and the flange 118 rests on the top of the bore 138 (i.e. on top of the floor plate 134) when the shock absorber 110 is in a compressed state. In these embodiments, when the shock absorber 110 is in a relaxed state, and the heel cap 70 is affixed to the bottom of the shoe 130, the top 112 of the shock absorber 110 extends above the floor plate 134. In addition, in these embodiments, the raised portion 78 (FIG. 6) of the heel cap 70 increases the distance by which the shock absorber 110 extends above the floor plate 134 when the shock absorber 110 is in its relaxed state.

In further alternative embodiments, the bore 138 extends through an opening in the floor plate 134 and through an opening in an insole placed on the floor plate 134, and the shock absorber 110 extends above both the floor plate 134 and an insole placed on the floor plate 134 (e.g. through an opening in the rear portion 136 of the floor plate 134 and a corresponding opening in the insole), and the flange 118 rests on the top of the bore 138 (i.e on top of the insole) when the shock absorber 110 is in a compressed state. In these embodiments, when the shock absorber 110 is in a relaxed state, and the heel cap 70 as affixed to the bottom of the shoe 130, the top 112 of the shock absorber 110 extends above the floor plate 134 and also above the insole. In addition, in these embodiments the raised portion 78 (FIG. 6) of the heel cap 70 increases the distance by which the shock absorber 110 extends above the insole when the shock absorber 110 is in its relaxed state.

FIG. 13 is a schematic, side, cross-sectional view of the rear portion of the shoe 130, shock absorber 110, and the heel cap 70 combination of FIG. 12. The shoe 130 includes: a heel cap 70 with its bottom surface 72, side surfaces 76, raised portion 78, and pegs 80; a shock absorber 110 having a top 112, upper plate 116, flange 118, elongated member 120, and compressible material 122; a rear end 131; a heel portion 132; an outsole bottom 133; a floor plate 134 having a rear portion 136; a bore 138; a support system 140; the heel portion 132 having a top 142, as discussed above. Additionally in this example, the bore 138 includes an interior surface 150, and the shoe 130 is shown resting on the ground 152.

In the example depicted in FIG. 13, the shock absorber 110 is shown in a relaxed state (e.g. without any downward pressure being applied from a person's foot) within the bore 138 in the heel portion 132. The top 112 of the shock absorber 110 extends above the bore 138. The shock absorber 110 rests on the raised portion 78 of the heel cap 70, which increases the distance by which the top 112 of the shock absorber 110 extends above the bore 138 when in a relaxed state. In this example, the raised portion 78 of the heel cap 70 is aligned with the bore 138. Without wishing to be bound to any particular theory, it is believed that the extension upward of the shock absorber 110 when in its relaxed state enhances the shock absorber's ability to correct for excessive supination or pronation of the gait by encouraging the user to step squarely (i.e. neutrally) on the shock absorber, 110, which is disposed at or near the center of the heel portion 132. The pegs 80 are shown embedded in the support system 140, thereby securing the heel cap 70 to the heel portion 132.

The shock absorber 110 is compressed when, e.g., a foot applies downward pressure onto the rear portion 136 of the floor plate 134. Applying downward force causes the shock absorber 110 to compress between the floor plate 134 and the raised portion 78 of the heel cap 70. Compression continues until the flange 118 of the shock absorber 110 rests on the support system 140 surrounding the top of the bore 138, preventing further compression of the shock absorber 110. In some embodiments, there is a gap between at least a portion of the shock absorber 110 and the interior surface 150 of the bore 138 when the shock absorber 110 is in a relaxed stated. In some embodiments, there is no gap between the shock absorber 110 and the interior surface 150 of the bore when the shock absorber is in a relaxed state. In some embodiments, when the shock absorber 110 is compressed in the manner just described, the compressible material 122 shrinks longitudinally (FIGS. 10-11) while expanding transversely outward such that at least a portion of the compressible material 122 contacts and presses against the interior surface 150 of the bore 138. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 described above or bore 138 described below) in response to the transverse expansion of the compressible material 122 also enhances the shock absorbing characteristics of the shock absorber 110, and also enhances the shock absorber's ability to correct for excessive supination or pronation of the gait. In this example, the interior surface 150 is tubular and sufficiently rigid to push back against compressible material 122 in its compressed state. However, other formations of the interior surface would also be suitable.

Figure 15:
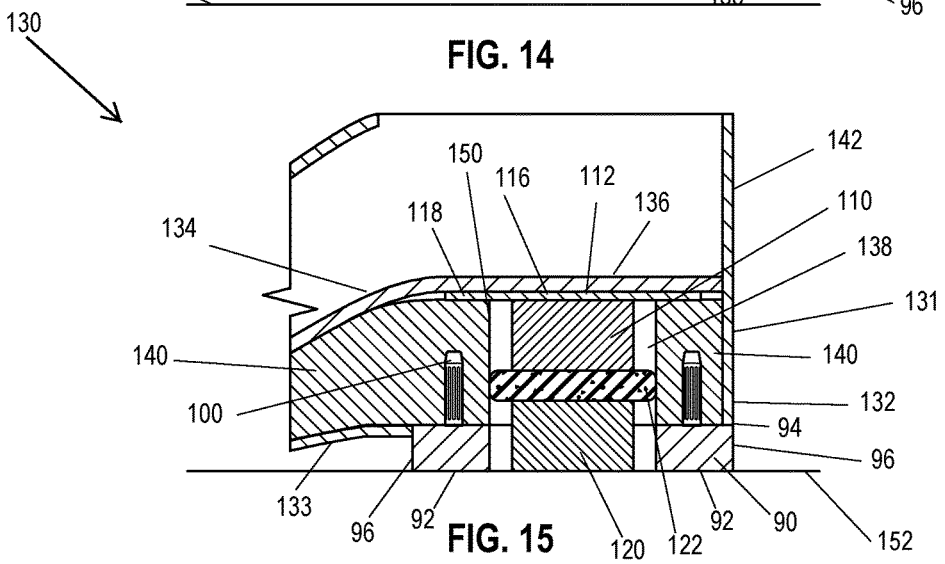
FIG. 15 is a schematic, side, cross-sectional view of the rear portion of the shoe, shock absorber, and heel combination of FIG. 14, illustrating the shock absorber in a compressed state.

FIG. 14 is a schematic, side, cross-sectional view of the rear portion of a shoe 130 including the shock absorber 110 of FIG. 10 in a relaxed state, and the heel cap 90 of FIG. 8; FIG. 15 is a schematic, side, cross-sectional view of the rear portion of the shoe 130, shock absorber 110, and heel cap 90 combination of FIG. 14, illustrating the shock absorber in a compressed state. With reference to FIGS. 14-15, the shoe 130 includes: a heel cap 90 with its bottom surface 92, top surface 94, side surfaces 96, opening 98, and pegs 100; a shock absorber 110 having a top 112, upper plate 116, flange 118, elongated member 120, and compressible material 122; a rear end 131; a heel portion 132; a bottom 133; a floor plate 134 having a rear portion 136; a bore 138; a support system 140; the heel portion 132 having a top 142, as discussed above. The bore 138 includes an interior surface 150, also discussed above. In addition, in FIG. 14 the shoe 130 is shown elevated above the ground 152; in FIG. 15 the shoe 130 is shown resting on the ground 152.

In the example depicted in FIG. 14, the shock absorber 110 is shown in a relaxed state (e.g. without any downward pressure being applied from a person's foot or with any upward pressure being applied by the ground 152) within the bore 138 in the heel portion 132. In this example, the opening 98 of the heel cap 90 is aligned with the bore 138. Unlike the embodiment shown in FIG. 13, in FIG. 14 the top 112 of the shock absorber rests against the support system 140, even when the shock absorber 110 is in a relaxed state. The shock absorber 110 then extends through the bore 138 and the opening 98 in the heel cap 90, such that the bottom of the shock absorber 110 extends below the heel cap 90, similar to the embodiment of FIG. 5. Without wishing to be bound to any particular theory, it is believed that the extension of the shock absorber 110 below the heel cap 90 when the shock absorber 110 is in its relaxed state enhances the shock absorber's ability to correct for excessive supination or pronation of the gait by encouraging the user to step squarely (i.e. neutrally) on the shock absorber 110, which is disposed at or near the center of the heel portion 132. The pegs 100 are shown embedded in the support system 140, thereby securing the heel cap 90 to the heel portion 132.

The shock absorber 110 is compressed when, e.g., a foot applies downward pressure onto the rear portion 136 of the floor plate 134 while the shoe is on the ground 152 as depicted in FIG. 15. Applying such downward force causes the shock absorber 110 to compress between the floor plate 134 and the ground 152. Compression continues until the bottom of the shock absorber 110 is level with the bottom surface 92 of the heel cap 90 (i.e. the bottom of the heel cap 90 rests on the ground 152), preventing further compression of the shock absorber 110. In some embodiments, when the shock absorber 110 is compressed in this manner, the compressible material 122 shrinks longitudinally (FIGS. 10, 11, 15) while expanding transversely outward such that at least a portion of the compressible material 122 contacts and presses against the interior surface 150 of the bore 138. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 described above or bore 138 described below) in response to the transverse expansion of the compressible material 122 also enhances the shock absorbing characteristics of the shock absorber 110, and also enhances the shock absorber's ability to correct for excessive supination or pronation of the gait. In this example, the interior surface 150 is tubular and sufficiently rigid to push back against compressible material 122 in its compressed state. However, other formations of the interior surface would also be suitable.

In other embodiments, the heel cap is not present and the bore does not extend all the way through the bottom of the shoe heel. Here, the bore 30 forms a well in which the shock absorber 110 is placed. This embodiment is related to the embodiment described in FIG. 13, except that the heel cap is not removable, and is instead fused with the heel portion of the shoe.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A device comprising:

a shoe heel, a bore having a top and a bottom and being vertically disposed in the shoe heel, and a shock absorber, the bore being defined by a first width and comprising an interior surface;

the shock absorber comprising an elongate member, and having a relaxed state and a compressed state;

the elongate member being defined by a second width when the shock absorber is in the relaxed state, the elongate member comprising a first portion having a first flexibility and a second portion comprising a compressible material having a second flexibility, the second flexibility being greater than the first flexibility, the second portion being closer to the bottom of the bore than the first portion;

wherein at least a portion of the shock absorber is disposed within the bore;

wherein in the relaxed state there is a gap between at least a portion of the shock absorber and the interior surface of the bore, the gap being defined by a difference between the first width and the second width, the second width being smaller than the first width, and wherein in the compressed state the compressible material is compressed vertically, and is expanded horizontally into at least a portion of the gap such that the compressible material applies pressure to the interior surface of the bore.

2. The device of claim 1, wherein the shoe heel comprises a bottom surface and the elongate member extends below the bottom surface when the shock absorber is in the relaxed state.

3. The device of claim 1, wherein the shock absorber comprises a flange that prevents the shock absorber from falling through the bottom of the bore.

4. The device of claim 1 further comprising a heel cap, the heel cap comprising a top surface, a bottom surface, and a raised portion extending above the top surface of the heel cap, wherein the elongated member rests on the raised portion when the shock absorber is in the compressed state.

5. The device of claim 4, wherein the elongated member also rests on the raised portion when the shock absorber is in the relaxed state.

6. The device of claim 1 further comprising a heel cap, the heel cap comprising a top surface, a bottom surface, and an opening extending between the top surface and the bottom surface, wherein the elongate member extends through the opening and below the bottom surface of the heel cap when the shock absorber is in the relaxed state.

7. The device of claim 6, wherein the shock absorber comprises a flange that rests on the top of the bore when the shock absorber is in the compressed state.

8. The device of claim 1, wherein the shoe heel comprises a rear portion of a floor plate that is not secured to a shoe.

9. The device of claim 8, wherein the shock absorber pushes the rear portion of the floor plate upward when the shock absorber moves from the compressed state to the relaxed state.

10. A device comprising:

a shoe heel, a bore having a top and a bottom and being vertically disposed in the shoe heel, a heel cap, and a shock absorber, the bore being defined by a first width and comprising an interior surface;

the shock absorber comprising an elongate member, a relaxed state, and a compressed state;

the elongate member being defined by a second width when the shock absorber is in the relaxed state, the elongate member comprising a first portion having a first flexibility and a second portion comprising a compressible material having a second flexibility, the second flexibility being greater than the first flexibility, the second portion being closer to the bottom of the bore than the first portion;

wherein at least a portion of the shock absorber is disposed within the bore;

wherein in the relaxed state there is a gap between at least a portion of the shock absorber and the interior surface of the bore, the gap being defined by a difference between the first width and the second width, the second width being smaller than the first width;

wherein in the compressed state the compressible material is compressed vertically, and is expanded horizontally into at least a portion of the gap such that the compressible material applies pressure to the interior surface of the bore; and wherein at least a portion of the heel cap is aligned with the bore.

11. The device of claim 10, wherein the heel cap comprises a top surface, a bottom surface, and a raised portion extending above the top surface of the heel cap, wherein the elongated member rests on the raised portion when the shock absorber is in the compressed state.

12. The device of claim 11, wherein the elongated member also rests on the raised portion when the shock absorber is in the relaxed state.

13. The device of claim 10 wherein the heel cap comprises a top surface, a bottom surface, and an opening extending between the top surface and the bottom surface and aligned with the bore, wherein the elongate member extends through the opening and below the bottom surface of the heel cap when the shock absorber is in the relaxed state.

14. The device of claim 13, wherein the shock absorber comprises a bottom and the bottom of the shock absorber is level with the bottom surface of the heel cap when the shock absorber is in the compressed state.

15. A device comprising:

a shoe heel, a heel cap, a bore having a top and a bottom and being vertically disposed in the shoe heel, and a shock absorber, the bore being defined by a first width and comprising an interior surface, a bottom, and a flange that prevents the shock absorber from falling through the bottom of the bore;

the shock absorber comprising an elongate member, a relaxed state, and a compressed state;

the elongate member being defined by a second width when the shock absorber is in the relaxed state, the elongate member comprising a first portion having a first flexibility and a second portion comprising a compressible material having a second flexibility, the second flexibility being greater than the first flexibility, the second portion being closer to the bottom of the bore than the first portion;

wherein at least a portion of the shock absorber is disposed within the bore;

wherein in the relaxed state there is a gap between at least a portion of the shock absorber and the interior surface of the bore, the gap being defined by a difference between the first width and the second width, the second width being smaller than the first width;

wherein in the compressed state the compressible material is compressed vertically, and is expanded horizontally into at least a portion of the gap such that the compressible material applies pressure to the interior surface of the bore;

wherein the heel cap comprises a top surface, a bottom surface, and an opening extending between the top surface and the bottom surface; and wherein the elongate member extends through the opening and below the bottom surface of the heel cap when the shock absorber is in the relaxed state.

* * * * *